US008757535B2

(12) United States Patent
Binner, Sr.

(10) Patent No.: US 8,757,535 B2
(45) **Date of Patent: *Jun. 24, 2014**

(54) METHOD FOR REDUCING WEB FEED RATE VARIATIONS INDUCED BY PARENT ROLL GEOMETRY VARIATIONS

(75) Inventor: Paul Alan Binner, Sr., Tunkhannock, PA (US)

(73) Assignee: The Procter & Gamble Company, Cincinnati, OH (US)

( * ) Notice: Subject to any disclaimer, the term of this patent is extended or adjusted under 35 U.S.C. 154(b) by 737 days.

This patent is subject to a terminal disclaimer.

(21) Appl. No.: 12/911,063

(22) Filed: Oct. 25, 2010

(65) Prior Publication Data

US 2012/0097785 A1 Apr. 26, 2012

(51) Int. Cl.
*B65H 59/02* (2006.01)

(52) U.S. Cl.
USPC ..... 242/563.1; 242/420.5

(58) Field of Classification Search
USPC ..... 242/413, 413.1, 413.2, 413.3, 413.4, 242/413.5, 413.9, 420, 420.1, 420.5, 563, 242/563.1
See application file for complete search history.

(56) References Cited

U.S. PATENT DOCUMENTS

| | | | | |
|---|---|---|---|---|
| 1,851,895 | A | 3/1932 | Cornet | |
| 2,634,607 | A | 4/1953 | Lawson | |
| 3,081,961 | A | 3/1963 | Kron | |
| 3,366,299 | A | 1/1968 | Rose et al. | |
| 3,603,521 | A | 9/1971 | Ormsby | |
| 3,718,037 | A | 2/1973 | Stringer et al. | |
| 3,860,188 | A * | 1/1975 | Bradshaw | 242/364.1 |
| 3,881,346 | A | 5/1975 | Scheucher | |
| 3,910,521 | A | 10/1975 | O'Callaghan et al. | |
| 3,912,145 | A | 10/1975 | Meihofer | |
| 3,933,035 | A | 1/1976 | Roch | |
| 4,199,118 | A | 4/1980 | Tetro et al. | |
| 4,278,213 | A | 7/1981 | Rubruck | |
| 4,286,757 | A | 9/1981 | Wirth | |
| 4,401,923 | A | 8/1983 | O'Gwynn | |
| 4,866,984 | A | 9/1989 | Houghton | |
| 5,083,487 | A | 1/1992 | Croteau | |
| 5,485,386 | A | 1/1996 | Andreasson | |
| 6,010,090 | A | 1/2000 | Bushmaker et al. | |
| 6,517,679 | B1 | 2/2003 | Mustonen et al. | |
| 6,698,323 | B2 | 3/2004 | Formon et al. | |
| 6,752,013 | B2 | 6/2004 | Cote et al. | |
| 6,845,282 | B2 * | 1/2005 | Franz | 700/122 |

(Continued)

FOREIGN PATENT DOCUMENTS

| | | |
|---|---|---|
| GB | 1 422 249 A | 1/1976 |
| GB | 1 422 250 A | 1/1976 |
| GB | 2 002 927 A | 2/1979 |
| JP | 9-142707 A | 6/1997 |

*Primary Examiner* — William A Rivera

(74) *Attorney, Agent, or Firm* — Wednesday G. Shipp; Peter D. Meyer

(57) ABSTRACT

A method is disclosed for reducing feed rate variations when unwinding a web material to transport the web material away from the parent roll at a web takeoff point where the feed rate variations are induced by parent roll geometry variations. The method utilizes both calculated and measured data to make suitable adjustments in the driving speed for an out-of-round parent roll to maintain a relative constant feed rate. By dividing the parent roll into 1, 2, . . . n sectors, the data can be refined to a relatively high degree taking into account high speed data processing capabilities as well as operating system response times to make appropriate driving speed adjustments.

15 Claims, 6 Drawing Sheets

(56) References Cited

U.S. PATENT DOCUMENTS

| | | | | |
|---|---|---|---|---|
| 6,945,922 | B2 | 9/2005 | Baggot et al. | |
| 6,993,964 | B2 | 2/2006 | Franz et al. | |
| 7,891,276 | B2 * | 2/2011 | Franklin et al. | 83/72 |
| 8,196,497 | B2 * | 6/2012 | Franklin et al. | 83/13 |
| 2003/0078684 | A1 | 4/2003 | Martin et al. | |
| 2003/0115946 | A1 | 6/2003 | Beuther et al. | |
| 2003/0156344 | A1 | 8/2003 | Chliwnyj et al. | |
| 2004/0044432 | A1 | 3/2004 | Franz | |
| 2009/0101746 | A1 | 4/2009 | Lanz | |

* cited by examiner

METHOD FOR REDUCING WEB FEED RATE VARIATIONS INDUCED BY PARENT ROLL GEOMETRY VARIATIONS

FIELD OF THE INVENTION

The present invention relates generally to methods for overcoming the problems associated with geometrically induced web feed rate variations during the unwinding of out-of-round parent rolls. More particularly, the present invention relates to a method for reducing the tension variations associated with web feed rate changes that are induced by parent roll geometry variations to minimize oscillation while maximizing operating speed throughout the entire unwinding cycle.

BACKGROUND OF THE INVENTION

In the papermaking industry, it is generally known that paper to be converted into a consumer product such as paper towels, bath tissue, facial tissue, and the like is initially manufactured and wound into large rolls. By way of example only, these rolls, commonly known as parent rolls, may be on the order of 10 feet in diameter and 100 inches across and generally comprise a suitable paper wound on a core. In the usual case, a paper converting facility will have on hand a sufficient inventory of parent rolls to be able to meet the expected demand for the paper conversion as the paper product(s) are being manufactured.

Because of the soft nature of the paper used to manufacture paper towels, bath tissue, facial tissue, and the like, it is common for parent rolls to become out-of-round. Not only the soft nature of the paper, but also the physical size of the parent rolls, the length of time during which the parent rolls are stored, and the fact that roll grabbers used to transport parent rolls grab them about their circumference can contribute to this problem. As a result, by the time many parent rolls are placed on an unwind stand they have changed from the desired cylindrical shape to an out-of-round shape.

In extreme cases, the parent rolls can become oblong or generally egg-shaped. But, even when the parent roll is are only slightly out-of-round, there are considerable problems. In an ideal case with a perfectly round parent roll, the feed rate of a web material coming off of a rotating parent roll can be equal to the driving speed of a surface driven parent roll. However, with an out-of-round parent roll the feed rate can likely vary from the driving speed of a surface drive parent roll depending upon the radius at the web takeoff point at any moment in time.

With regard to the foregoing, it will be appreciated that the described condition assumes that the rotational speed of the parent roll remains substantially constant throughout any particular rotational cycle of the parent roll.

If the rotational speed remains substantially constant, the feed rate of a web material coming off of an out-of-round parent roll will necessarily vary during any particular rotational cycle depending upon the degree to which the parent roll is out-of-round. In practice, however, parent rolls are surface driven which means that if the radius at the drive point changes, the rotational speed can also change generally causing variations in the feed rate. Since the paper converting equipment downstream of the unwind stand is generally designed to operate based upon the assumption that the feed rate of a web material coming off of a rotating parent roll will always be equal to the driving speed of the parent roll, there are problems created by web tension spikes and slackening.

While a tension control system is typically associated with the equipment used in a paper converting facility, the rotational speed and the takeoff point radius can be constantly changing in nearly every case. At least to some extent, this change is unaccounted for by typical tension control systems. It can be dependent upon the degree to which the parent roll is out-of-round and can result in web feed rate variations and corresponding tension spikes and slackening.

With an out-of-round parent roll, the instantaneous feed rate of the web material can be dependent upon the relationship at any point in time of the radius at the drive point and the radius at the web takeoff point. Generally and theoretically, where the out-of-round parent roll is generally oblong or egg-shaped, there will be two generally diametrically opposed points where the radius of the roll is greatest. These two points will be spaced approximately 90° from the corresponding generally diametrically opposed points where the radius of a roll is smallest. However, it is known that out-of-round parent rolls may not be perfectly oblong or elliptical but, rather, they may assume a somewhat flattened condition resembling a flat tire, or an oblong or egg-shape, or any other out-of-round shape depending upon many different factors.

Regardless of the exact shape of the parent roll, at least one point in the rotation of the parent roll exists where the relationship between the web take off point radius and the parent roll drive point radius that results in the minimum feed rate of paper to the line. At this point, the web tension can spike since the feed rate of the web material is at a minimum and less than what is expected by the paper converting equipment downstream of the unwind stand. Similarly, there can exist at least one point in the rotation of the parent roll where the relationship between the web take off point radius and the parent roll drive point radius results in the maximum feed rate of paper to the line. At this point, the web tension can slacken since the feed rate of the web material can be at a maximum and more than what is expected by the paper converting equipment downstream of the unwind stand. Since neither condition is conducive to efficiently operating paper converting equipment for manufacturing paper products such as paper towels, bath tissue and the like, and a spike in the web tension can even result in a break in the web material requiring a paper converting line to be shut down, there clearly is a need to overcome this problem.

In particular, the fact that out-of-round parent rolls create variable web feed rates and corresponding web tension spikes and web tension slackening has required that the unwind stand and associated paper converting equipment operating downstream thereof be run at a slower speed in many instances thereby creating an adverse impact on manufacturing efficiency.

While various efforts have been made in the past to overcome one or more of the foregoing problems with out-of-round parent rolls, there has remained a need to successfully address the problems presented by web feed rate variations and corresponding web tension spikes and web tension slackening.

SUMMARY OF THE INVENTION

While it is known to manufacture products from a web material such as paper towels, bath tissue, facial tissue, and the like, it has remained to provide methods for reducing feed rate variations in the web material when unwinding a parent roll. Embodiments of the present disclosure described in detail herein provide methods having improved features which result in zo multiple advantages including enhanced reliability and lower manufacturing costs. Such methods not only overcome problems with currently utilized conventional manufacturing operations, but they also make it possible to minimize wasted materials and resources associated with such manufacturing operations.

In certain embodiments, the method can reduce feed rate variations in a web material when unwinding a parent roll to transport the web material away from the parent roll at a web takeoff point. The method can comprise dividing the parent roll, which has a core plug mounted on a shaft defining a longitudinal axis of the parent roll, into a plurality of angular sectors disposed about the longitudinal axis. An ideal speed reference signal corresponding to an ideal parent roll rotation speed for a round parent roll can be used to drive the parent roll at a driving speed and at a location on the outer surface either coincident with or spaced from the web takeoff point. The method can further comprise correlating each of the sectors at the web takeoff point with a corresponding one of the sectors at the drive point. In addition, the method can include determining an instantaneous rotational speed for each of the sectors as the parent roll is being driven, for example, by a motor-driven belt on the outer surface thereof.

In these embodiments, the method includes calculating the radius at the drive point from the driving and rotational speeds for each of the sectors. It also includes determining an ideal drive point radius by averaging the calculated drive point radii for all of the sectors and calculating a drive point correction factor for each of the sectors where the drive point correction factor is a function of the calculated drive point radius and the ideal drive point radius. In these embodiments, the method includes measuring the radius at or near the web takeoff point of the parent roll for each of the sectors as the parent roll is being driven at the drive point.

In addition, the method includes calculating an ideal web takeoff point radius by determining an average for the measured web takeoff radii for all of the sectors and calculating a to web takeoff point correction factor for the radius at the web takeoff point for each of the sectors where the web takeoff point correction factor is a function of the ideal and measured web takeoff point radius for each of the sectors.

The method also includes calculating a total correction factor for each of the sectors as a function of the drive point correction factor and the web takeoff point correction factor. The method corrects the driving speed of the parent roll on a sector-by-sector basis using the ideal speed reference signal. The ideal speed reference signal is initially used to control the parent roll rotation speed based upon operator input (assuming a perfectly round parent roll) as well as other factors, such as tension control system feedback and ramp generating algorithms. The ideal speed reference signal is multiplied by the total correction factor for each sector of the parent roll to generate a corrected speed reference signal for each sector. The corrected speed reference signal is calculated on the fly (and not stored) based upon the ideal speed reference signal from moment to moment, taking into account factors such as tension control system feedback and ramp generating algorithms. Finally, the method in these embodiments includes using the corrected speed reference signal to adjust the driving speed of the parent roll for each sector to the corrected driving speed.

Adjusting the driving speed of the parent roll in this manner can cause the web feed rate of the parent roll to better approximate the web feed rate of an ideal (perfectly round) parent roll on a continuous basis during the unwinding of a web material from a parent roll. As a result, feed rate variations in the web material at the web takeoff point can be reduced or even eliminated. Thus, any web tension spikes and slackening associated with radial deviations from a perfectly round parent roll can be minimized or even eliminated.

DETAILED DESCRIPTION OF THE INVENTION

In the manufacture of web material products including paper products such as paper towels, bath tissue, facial tissue, and the like, the web material which is to be converted into such products is initially manufactured on large parent rolls and placed on unwind stands. The embodiments described in detail below provide exemplary, non-limiting examples of methods for reducing feed-rate variations in a web material when unwinding a parent roll to transport the web material from the parent roll at a web takeoff point. In particular, the embodiments described below provide exemplary, non-limiting methods which take into account any out-of-round characteristics of the parent roll and make appropriate adjustments to reduce web feed rate variations.

With regard to these non-limiting examples, the described methods make it possible to effectively and efficiently operate an unwind stand as part of a paper converting operation at maximum operating speed without encountering any significant and/or damaging deviations in the tension of the web material as it leaves an out-of-round parent roll at the web takeoff point.

In order to understand the methods making it possible to reduce feed rate variations in a web material as it is being transported away from an out-of-round parent roll, it is instructive to consider certain calculations, compare an ideal parent roll case with an out-of-round parent roll case, and describe the effects of out-of-round parent rolls on the web feed rate and web material tension.

Web Feed Rate Calculation

The instantaneous feed rate of a web material coming off of a rotating parent roll at any point in time, $Rate_i$, can be represented as a function of at least two variables. The two most significant variables involved are the rotational speed, $\Omega_i$, of the parent roll at any given moment and the effective radius, $R_{tp}$, of the parent roll at the web takeoff point at that given moment. The instantaneous feed rate of the web material may be represented by the following equation:

$$Rate_i=\Omega_i(2\pi R_{tp}) \quad \text{Equation 1}$$

Figure 1:
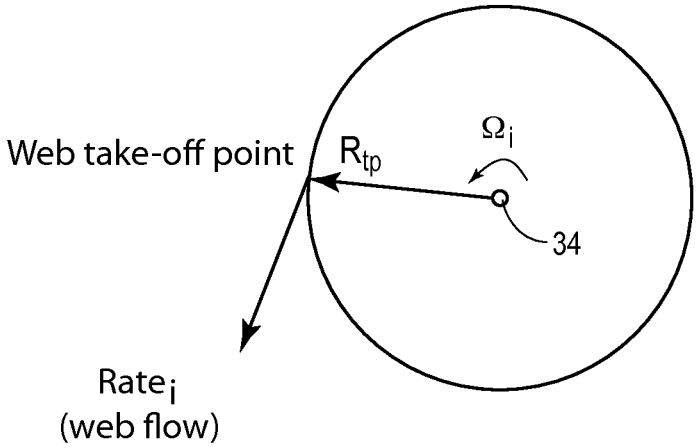
FIG. 1 is a diagram illustrating equation concepts involving the web flow feed rate, $Rate_i$, the rotational speed, $\Omega_i$, and the web takeoff point radius $R_{tp}$, for a parent roll.

Where:

$Rate_i$ represents the instantaneous feed rate of the web material from the parent roll $\Omega_i$ represents the instantaneous rotational speed of a surface driven parent roll $R_{tp}$ represents the instantaneous radius of the parent roll at the web takeoff point Referring to FIG. 1, the concepts from Equation 1 can be better understood since each of the variables in the equation is diagrammatically illustrated.

Furthermore, the instantaneous rotational speed, $\Omega_i$, of a surface driven parent roll is a function of two variables. The two variables involved are the instantaneous surface or driving speed, $M_i$, of the mechanism that is moving the parent roll and the instantaneous radius of the parent roll at the point or location at which the parent roll is being driven, $R_{dp}$. The instantaneous rotational speed may be represented by the following equation:

$$\Omega_i=M_i/(2\pi R_{dp}) \quad \text{Equation 2}$$

Figure 2:
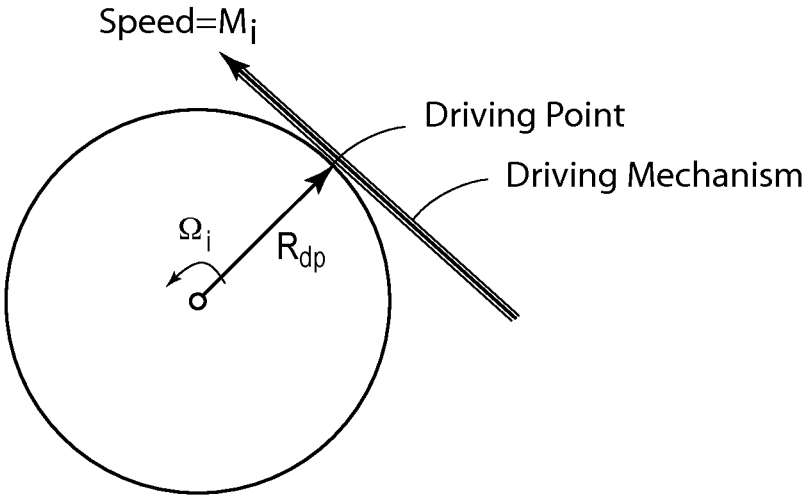
FIG. 2 is a diagram illustrating equation concepts involving the rotational speed, $\Omega_i$, the driving speed, $M_i$, and the drive point radius, $R_{dp}$, for a parent roll.

Where:

$\Omega_i$ represents the instantaneous rotational speed of a surface driven parent roll $M_i$ represents the instantaneous driving speed of the parent roll driving mechanism $R_{dp}$ represents the instantaneous radius of the parent roll at the drive point Referring to FIG. 2, the concepts from Equation 2 can be better understood since each of the variables in the equation is diagrammatically illustrated.

With regard to the instantaneous drive point radius, $R_{dp}$, it can be determined from Equation 2 by multiplying both sides of the equation by $R_{dp}/\Omega_i$ to give Equation 2a below:

$$R_{dp}=M_i/2\pi\Omega_i \quad \text{Equation 2}$$

Substituting $M_i/(2\pi R_{dp})$ for $\Omega_i$ in Equation 1 (based on Equation 2) results in Equation 3 which relates the instantaneous feed rate, $Rate_i$, of the web material from the parent roll to the to instantaneous driving speed, $M_i$, of the parent roll driving mechanism, the instantaneous radius, $R_{dp}$, of the parent roll at the drive point, and the instantaneous radius, $R_{tp}$, of the parent roll at the web takeoff point:

$$Rate_i=[M_i/(2\pi R_{dp})]\times[2\pi R_{tp}] \quad \text{Equation 3}$$

If Equation 3 is simplified by canceling out the $2\pi$ factor in the numerator and denominator, the resulting Equation 4 becomes:

$$Rate_i=M_i\times[R_{tp}/R_{dp}] \quad \text{Equation 4}$$

Figure 3:
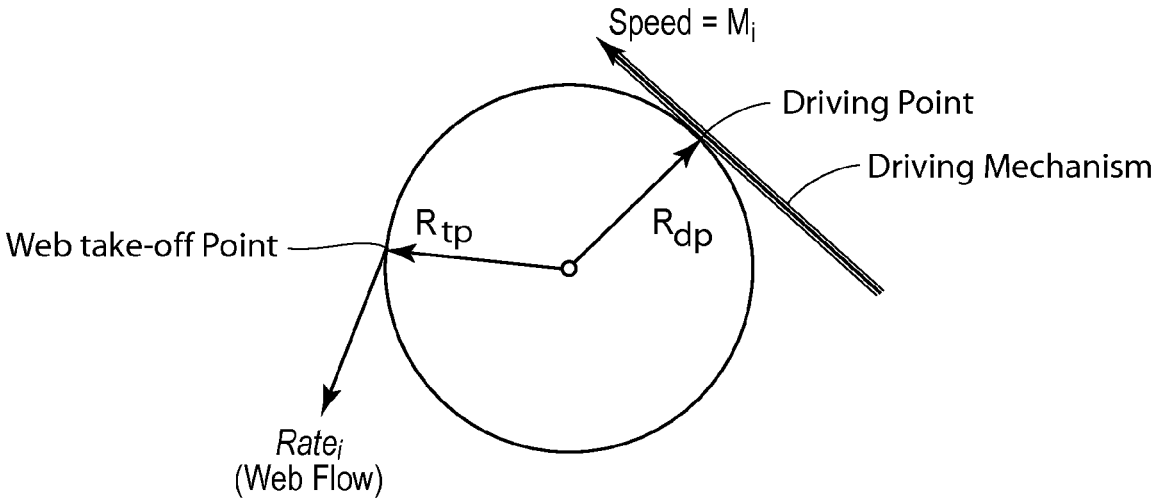
FIG. 3 is a diagram illustrating equation concepts involving the web flow feed rate, $Rate_i$, the web takeoff point radius, $R_{tp}$, and the web drive point radius, $R_{dp}$, for a parent roll.

Referring to FIG. 3, the concepts from Equation 4 can be better understood since each of the variables in the equation is diagrammatically illustrated.

Ideal Parent Roll Case

Figure 4:
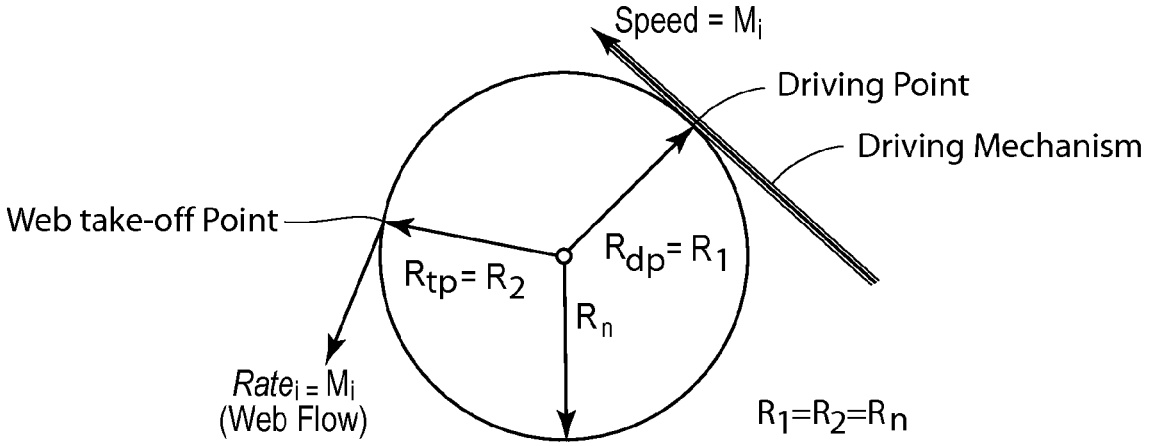
FIG. 4 is a diagram illustrating equation concepts involving the web flow feed rate, $Rate_i$, and the driving speed, $M_i$, for the case where the parent roll is perfectly round.

In the ideal parent roll case (see FIG. 4), the parent roll on the unwind stand is perfectly round which results in the radii at all points about the outer surface being equal and, as a consequence, the instantaneous radius, $R_{dp}$, of the parent roll at the drive point is equal to the instantaneous radius, $R_{tp}$, of the parent roll at the web takeoff point. For the ideal parent roll case, $R_{tp}=R_{dp}$ so, in Equation 4, it will be appreciated that the equation will simplify to $Rate_i=M_i$, i.e., the instantaneous feed rate of the web material from the parent roll will be equal to the instantaneous driving speed of the driving mechanism on the outer surface of the parent roll.

The Out-of-Round Parent Roll

In situations where a parent roll is introducing web material into the paper converting equipment is not perfectly round, the differences between $R_{dp}$ and $R_{tp}$ should be taken into account. In practice, it is known that one type of out-of-round parent roll can be an "egg shaped" parent roll characterized by a major axis and a minor axis typically disposed about 90 degrees out of phase. However, the exact shape of the parent roll as well as the angular relationship of the major axes and the minor axes will be understood by one of skill in the art to vary from parent roll to parent roll.

Figure 6:
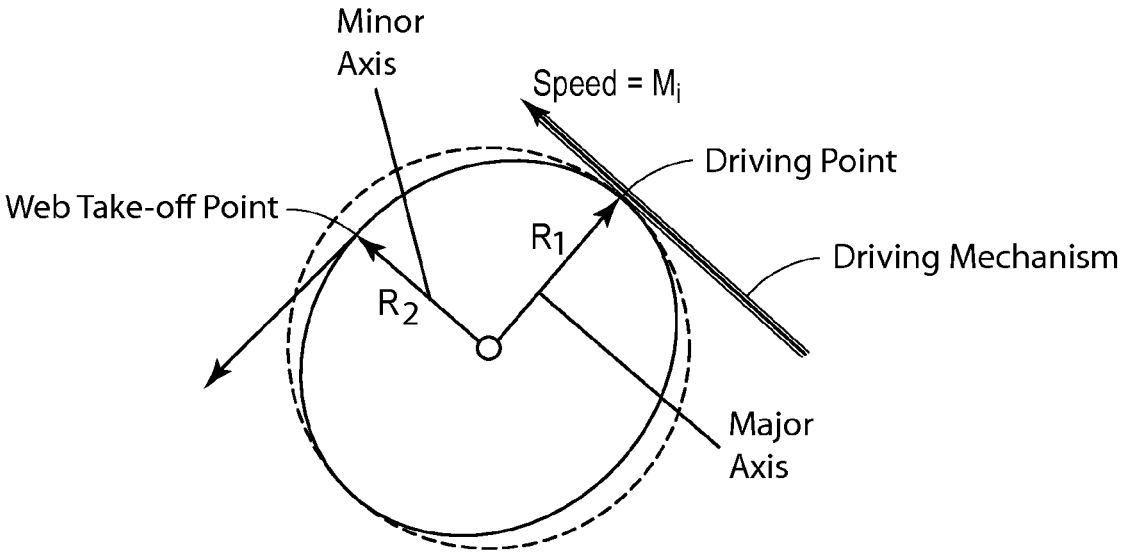
FIG. 6 is a diagram illustrating an out-of-round parent roll having a major axis, R1, to orthogonal to the drive point and a minor axis, R2, orthogonal to the web takeoff point.
Figure 7:
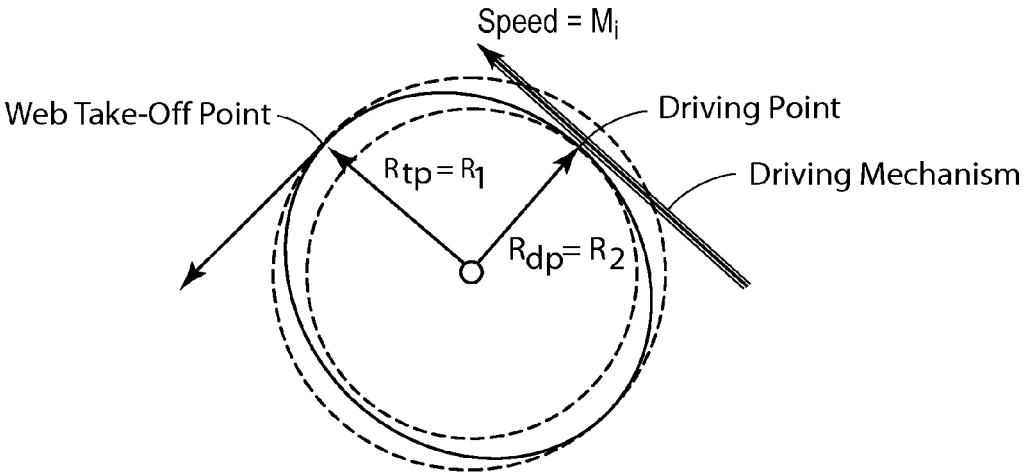
FIG. 7 is a diagram illustrating an out-of-round parent roll having a minor axis, R2, orthogonal to the drive point and a major axis, R1, orthogonal to the web takeoff point.

For purposes of illustration only, FIG. 6 is a diagram of an out-of-round parent roll having w a major axis, R1, orthogonal to the drive point and a minor axis, R2, orthogonal to the web takeoff point, and FIG. 7 is a diagram of an out-of-round parent roll having a minor axis, R2, orthogonal to the drive point and a major axis, R1, orthogonal to the web takeoff point.

Effects of Out-of-Round Parent Rolls on Web Feed Rate and Tension

When the driving mechanism on an unwind stand is driving an out-of-round parent roll, there can be a continuously varying feed rate of the web material from the parent roll. The varying web feed rates at the web takeoff point can typically reach a maximum and a minimum in two different cases. To understand the concepts, it is useful to consider the web takeoff point while assuming the parent roll drive point and the web takeoff point are 90 degrees apart.

Figure 5:
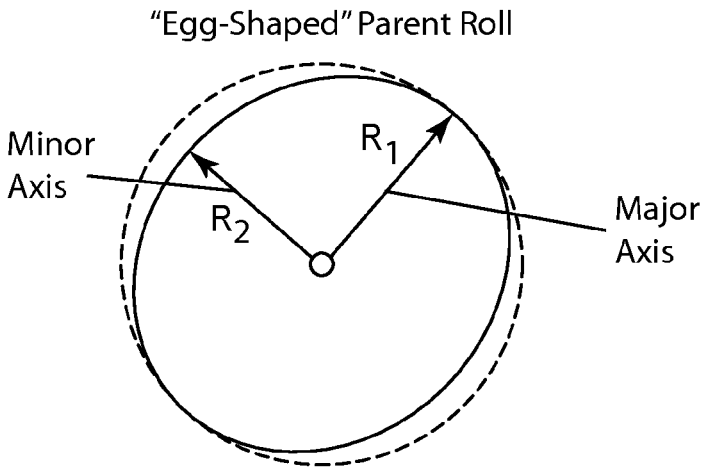
FIG. 5 is a diagram illustrating an out-of-round parent roll having a major axis, R1, and a minor axis, R2, which are approximately 90 degrees out of phase.

Case 1 is when the major axis of the parent roll, represented by R1 in FIGS. 5 and 6, is orthogonal to the drive point of the parent roll and the minor axis of the parent roll, represented by R2 in FIGS. 5 and 6, is orthogonal to the web takeoff point of the parent roll.

For illustrative purposes only, it may be assumed that the parent roll started out with the radii at all points about the outer surface of the parent roll equal to 100 units. However, it may also be assumed that due to certain imperfections in the web material and/or roll handling damage, $R1=R_{dp}=105$ and $R2=R_{tp}=95$. Further, for purposes of illustration it may also be assumed that the driving speed, $M_i$, of the driving mechanism is 1000 units.

Substituting these values into Equation 4 [$Rate_i=M_i\times[R_{tp}/R_{dp}]$] produces:

$Rate_i=1000\times[95/105]=904.76$ units of web material/unit time

In this case, the paper converting line was expecting web material at a rate of 1000 units per unit time but was actually receiving web at a rate of 904.76 units per unit time.

For the conditions specified above for illustrative purposes only, Case 1 can represent the web material feed rate when it is at a minimum value and, consequently, it also represents the web tension when it is at a maximum value.

Case 2 is when the parent roll has rotated to a point where the major axis, represented by R1 in FIG. 7, is orthogonal to the web takeoff point of the parent roll and the minor axis, represented by R2 in FIG. 7, is orthogonal to the drive point of the parent roll.

For illustrative purposes only, it can be assumed that the same parent roll described in Case 1 is being used where now $R1=R_{dp}=95$ and $R2=R_{tp}=105$, and for illustrative purposes, it may still be assumed that the driving speed, is 1000 units.

Substituting these values into Equation 4 [$Rate_i=M_i\times[R_{tp}/R_{dp}]$] produces:

$Rate_i=1000\times[105/95]=1105.26$ units of web material/unit time

In this case, the paper converting line was expecting web material at a rate of 1000 units per unit time but was actually receiving web at a rate of 1105.26 units per unit time.

For the conditions specified above for illustration purposes only, Case 2 represents the web material feed rate when it is at a maximum value and, consequently, it also represents the web tension when it is at a minimum value As Case 1 and 2 illustrate, the variations in radius of an out-of-round parent roll can produce significant variations in web feed rate as the parent roll is surface driven at a constant speed, $M_i$.

Solution to the Problem

Figure 8:
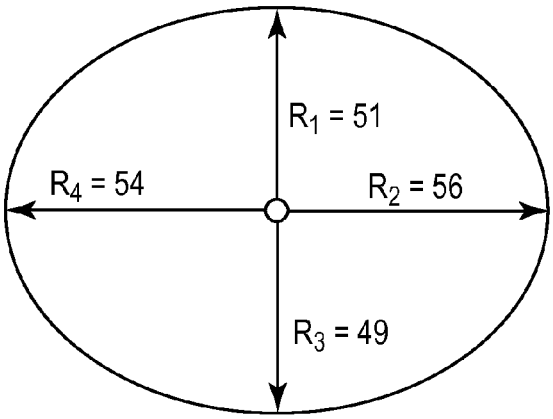
FIG. 8 is a diagram illustrating an out-of-round parent roll that is generally egg shaped having unequal major axes and unequal minor axes.
Figure 9:
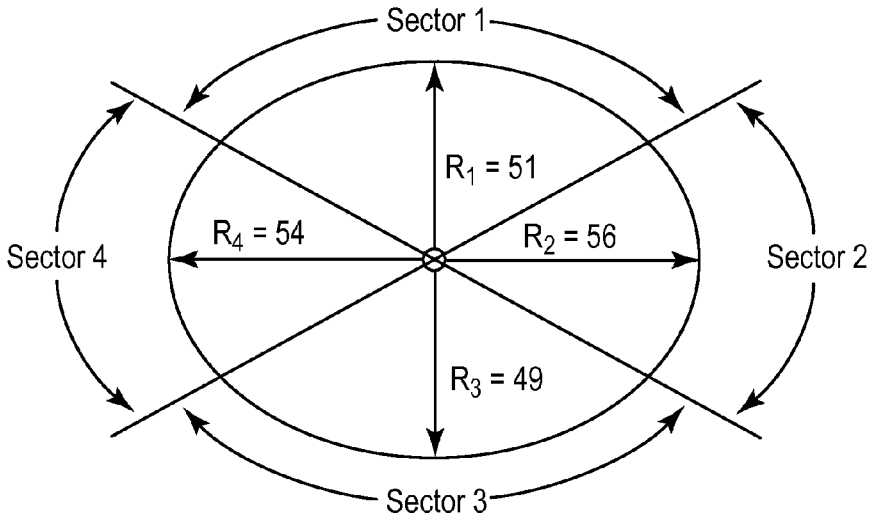
FIG. 9 is a diagram illustrating the out-of-round parent roll of FIG. 8 which has been divided into four sectors, 1-4.
Figure 10:
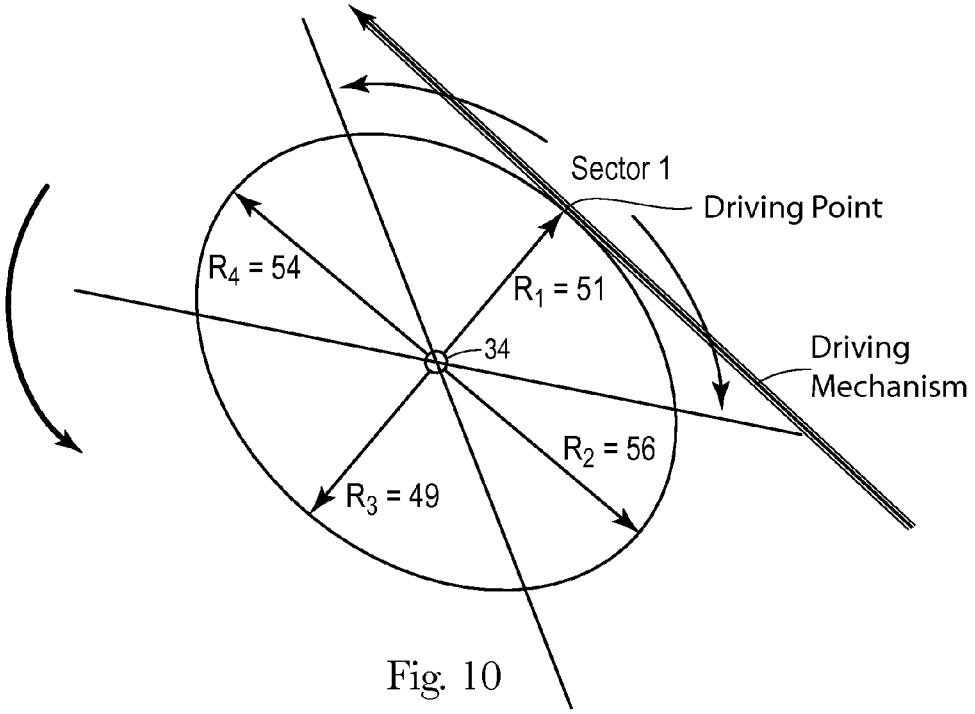
FIG. 10 is a diagram illustrating the out-of-round parent roll of FIG. 8 with the larger of the minor axes, R1, at the drive point.

The solution to reducing web feed rate variations as the out-of-round parent roll is being surface driven can be illustrated by an example comprising a number of steps, as follows:

1. Start with an exemplary simple "egg-shaped" parent roll that has the following properties:
   a. It is asymmetrical
   b. It has a minor axis of 100 that is shown vertically in FIG. 8 as being comprised of a radius $R_1=51$ directly opposite a radius $R_3=49$.
   c. It has a major axis of 110 that is shown horizontally in FIG. 8 as being comprised of a radius $R_2=56$ directly opposite a radius $R_4=54$.
2. Divide the parent roll into n sectors, e.g., the value of n shown in FIG. 9 is 4 to simplify the example, but actual values of n could be 20 or higher depending on the application, the speed at which information can be processed, and the responsiveness of the system.
3. Create a table of n rows (one for each of the n sectors) with columns for the following information:
   a. Sector #
   b. $R_{dp}$—Drive Point Radius
   c. $C_{dp}$—Correction Factor for Drive Point
   d. $R_{tp}$—Web Takeoff Point Radius
   e. $C_{tp}$—Correction Factor for Web Takeoff Point
   f. $C_r$—Total Correction Factor

| Sector # | $R_{dp}$ | $C_{dp}$ | $R_{tp}$ | $C_{tp}$ | $C_t$ |
|---|---|---|---|---|---|
| 1 | | | | | |
| 2 | | | | | |
| 3 | | | | | |
| 4 | | | | | |

$R_{dpi}=$
$R_{tpi}=$

In addition to creating the table, two new variables need to be defined. These two new variables include the Ideal Drive Point Radius, $R_{dpi}$, and the Ideal Web Takeoff Point Radius, $R_{tpi}$. The manner of determining these variables is described below.

4. Calculate the Drive Point Radius, $R_{dp}$, for each of the sectors, 1, 2, . . . n, of the parent roll. Using a parent roll rotational speed and position determining device, e.g., a shaft encoder, it is possible to develop two critical pieces of information for making the calculation for each of the sectors, 1, 2 , . . . n, of the parent roll:
   a. The present rotational position of the parent roll
   b. The present rotational speed of the parent roll Thus, as the parent roll rotates, the rotational position information provided by the parent roll rotational speed and position determining device is used to determine which sector of the parent roll is presently being driven. By using the relationship from Equation 2a, $R_{dp}=M_i/2\pi\Omega_i$, it is possible to calculate $R_{dp}$ for that sector by dividing the driving speed, $M_i$, (which is known by the logic device) by the rotational speed, $\Omega_i$, (reported by the parent roll rotational speed and position determining device) times $2\pi$. When this value has been calculated, it can be stored in the table above to create a mathematical representation of the shape of the parent roll from the drive point perspective.
5. Calculate the Ideal Drive Point Radius, $R_{dpi}$, for the parent roll by adding the $R_{dp}$ values from the table for all of the sectors, 1, 2 , . . . n, and dividing the sum by the total number of sectors, n, to determine the average.
6. Calculate the Drive Point Correction Factor, $C_{dp}$, for each of the sectors, 1, 2 , . . . n, of the parent roll using the formula: $C_{dp}$ (1, 2 . . . n)=$R_{dp}$(1, 2 , . . . n)/$R_{dpi}$.
7. Measure the Web Takeoff Point Radius, $R_{tp}$, for each of the sectors, 1, 2 , . . . n, and store these values in the table to create a mathematical representation of the shape of the parent roll from a web takeoff point perspective. For purposes of illustration only, it can be assumed that the measurement of the Web Takeoff Point Radius, $R_{tp}$, can occur at the exact point where the web is actually coming off of the parent roll so that the reading of the Web Takeoff Point Radius, $R_{tp}$, for a given sector corresponds to the Drive Point Radius, $R_{dp}$, calculated for the sector corresponding to that given sector. However, in practice the Web Takeoff Point Radius, $R_{tp}$, may be measured any number of degrees ahead of the actual web take-off point (to eliminate the effects of web flutter at the actual web take off point and also to permit a location conducive to mounting of the sensor) and through data manipulation techniques, be written into the appropriate sector of the data table.
8. Calculate the Ideal Web Takeoff Point Radius, $R_{tpi}$, for the parent roll by adding the $R_{tp}$ values from the table for all of the sectors, 1, 2 , . . . n, and dividing the sum by the total number of sectors, n, to determine the average.
9. Calculate the Web Takeoff Point Correction Factor, $C_{tp}$, for each of the sectors, 1, 2 , . . . n, of the parent roll using the formula: $C_{tp}$, (1, 2 , . . . n)=$R_{tpi}/R_{tp}$(1, 2 , . . . n).
10. For each of the sectors, 1, 2 , . . . n, calculate the Total Correction Factor, $C_t$(1, 2 , . . . n), by multiplying the Drive Point Correction Factor, $C_{dp}$(1, 2 , . . . n), by the Web Takeoff Point Correction Factor, $C_{tp}$(1, 2 , . . . n).
11. Correct the driving speed, $M_i$, of the parent roll on a sector by sector basis as the parent roll rotates using an ideal speed reference signal, $SRS_i$, corresponding to an ideal parent roll rotation speed. (The ideal speed reference signal, $SRS_i$, is initially used to control the parent roll rotation speed based upon operator input (assuming a perfectly round parent roll) as well as other factors, such as tension control system feedback and ramp generating algorithms.)
12. Multiply the ideal speed reference signal, $SRS_i$, by the Total Correction Factor, $C_t$(1, 2, . . . n), for each sector of the parent roll to generate a corrected speed reference signal, $SRS_{iCorrected}$, for each sector. ($SRS_{iCorrected}$ for each sector is calculated on the fly (and not stored) based upon the ideal speed reference signal, SRS, from moment to moment, noting that SRS, already takes into account factors such as tension control system feedback and ramp generating algorithms.)

13. Finally, adjust the driving speed, $M_i$, to a corrected driving speed, $M_{iCorrected}$, as each sector approaches or is at the drive point using the corrected speed reference signal, $SRS_{iCorrected}$, for each sector. (Adjusting the driving speed of the out-of-round parent roll in this manner causes the feed rate of the web to at least approximate the feed rate off of an ideal (perfectly round) parent roll. As a result, feed rate variations in the web material at the web takeoff point are reduced or eliminated and, thus, web tension spikes and web tension slackening associated with radial deviations from a perfectly round parent roll are eliminated or at least minimized.)

Following the above procedure, and assuming the measured and calculated values are as set forth above for sectors 1-4 where R1=51, R2=56, R3=49 and R4=54, the Total Correction to Factor, $C_T$, can be determined using the table above and the steps set forth above in the following manner:

| Sector # | $R_{dp}$ | $C_{dp}$ | $R_{tp}$ | $C_{tp}$ | $C_t$ |
|---|---|---|---|---|---|
| 1 | 51 | 0.971 | 54 | 0.97 | 0.94 |
| 2 | 56 | 1.066 | 51 | 1.03 | 1.10 |
| 3 | 49 | 0.933 | 56 | 0.94 | 0.87 |
| 4 | 54 | 1.029 | 49 | 1.07 | 1.10 |

$R_{dpi} = 52.5$
$R_{tpi} = 52.5$

Other factors that may need to be taken into account can include the fact that as the parent roll unwinds, the shape of the parent roll can change making it necessary to periodically remeasure and recalculate the various parameters noted above. At some point during unwinding of the parent roll, the rotational speed of the parent roll may be too fast for correction of the driving speed, although typically this will not occur until the parent roll becomes smaller and less out-of-round.

From the foregoing, it will be appreciated that the method of the present invention can reduce variations in the feed rate, and hence variation in tension in a web material when unwinding a parent roll to transport the web material away from the parent roll at a web takeoff point. This can be accomplished by initially dividing the parent roll into a plurality of angular sectors which are disposed about the longitudinal axis defined by the shaft on which the core plug of the parent roll is mounted (see FIG. 9). The angular sectors may advantageously be equal in size such that each sector, S, measured in degrees may be determined by the formula: S 360°/n where n is the total number of sectors. The method can include using an ideal speed reference signal corresponding to an ideal parent roll rotation speed for a round parent roll to drive the parent roll at a speed and at a location on the outer surface which is located in spaced relationship to the web takeoff point where the web leaves the convolutely wound roll. It may be possible in some configurations of the line for the web takeoff point to be coincident with part of the surface that is being driven. The method also can include correlating each of the sectors at the web takeoff point with a corresponding sector at the drive point to account for the drive point and web takeoff point being angularly spaced apart. In addition, the feed rate variation reduction method can include determining an instantaneous rotational speed for each of the sectors as the parent roll is driven, e.g., by a motor-driven belt on the outer surface thereof.

Further, the method can include calculating the radius at the drive point as a function of the driving and rotational speeds for each of the sectors. The method also can include determining an ideal drive point radius by averaging the calculated drive point radii for all of the sectors and calculating a drive point correction factor for the radius at the drive point for each of the sectors where the drive point correction factor is a function of the calculated drive point radius and the ideal drive point radius. Still further, the feed rate variation reducing method can include measuring the radius at the web takeoff point for each of the sectors as the parent roll is driven.

In addition, the method may include calculating an ideal web takeoff point radius by averaging the measured web takeoff radii for all of the sectors and calculating a web takeoff point correction factor for each of the sectors as a function of the ideal and measured web takeoff point radii for each of the sectors. The method can also include calculating a total correction factor for each of the sectors as a function of the drive point correction factor and the web takeoff point correction factor for each of the sectors and multiplying the total correction factor for each of the sectors by the ideal speed reference signal to establish a corrected speed reference signal for each of the sectors. The method preferably adjusts the driving speed of the parent roll on a sector by sector basis to a corrected driving speed as each of the sectors approaches or is at the drive point using the corrected speed reference signal to at least approximate the web feed rate of an ideal parent roll, thus eliminating or at least reducing geometrically induced feed rate variations in the web material at the web takeoff point.

The ideal speed reference signal can be initially used to control the parent roll rotation speed based upon operator input (assuming a perfectly round parent roll) as well as other factors, such as tension control system feedback and ramp generating algorithms. As noted above, the ideal speed reference signal is multiplied by the total correction factor for each sector of the parent roll to generate a corrected speed reference signal for each sector. The corrected speed reference signal for each sector can be calculated on the fly (and not stored) based upon the ideal speed reference signal from moment to moment, noting that the ideal speed reference signal already takes into account factors such as tension control system feedback and ramp generating algorithms. Finally, and as noted above, the method in these embodiments includes using the corrected speed reference signal for each sector to adjust the driving speed of the parent roll for each sector to a corrected driving speed.

Adjusting the driving speed of the parent roll in the foregoing manner can cause the web feed rate of the parent roll to at least approximate the web feed rate of an ideal parent roll on a continuous basis during the entire cycle of unwinding a web material from a parent roll on an unwind stand. Accordingly, web feed rate variations in the web material at the web takeoff point are reduced or eliminated and, as a result, it follows that web tension spikes and web tension slackening associated with radial deviations from a perfectly round parent roll are eliminated or at least minimized As will be appreciated from the foregoing, the parent roll can be divided into 1, 2 , . . . n equal angular sectors about the longitudinal axis for data analysis, collection and processing. Further, the parent roll can be driven by any conventionally known means such as a motor-driven is belt that is in contact with the outer surface of the parent roll. In such a case there may not be a single "drive point" as such but, rather, the belt can wrap around the parent roll to some degree. It should be noted that for an out-of-round parent roll, the amount of belt wrap on the parent roll can be constantly changing based on the particular geometry of the roll under, and in contact with the belt. An advantage of the method described herein is that these effects can be ignored as the only data that is recorded is the effective drive point radius, as calculated elsewhere in this document. Only for purposes of visualizing the method described herein, a point such as the midpoint of belt contact with the parent roll can be selected as the drive point, although in practice the actual drive point used by the algorithms described infra can be based upon calculated values and may vary from the physical midpoint of the belt.

With regard to other equipment used in practice, they can also be of a conventionally known type to provide the necessary data. For instance, a conventional distance measurement device can be used to measure the radius at the web takeoff point. Suitable distance measuring devices include, but are not limited to, lasers, ultrasonic devices, conventional measurement devices, combinations thereof, and the like. One skilled in the art will appreciate that the distance reported from the measuring device to the parent roll surface may need to be subtracted from the known distance from the measuring device to the center of the parent roll to derive the radius of the parent roll from this measurement. Similarly, a conventional optical encoder, a resolver, a synchro, a rotary variable differential transformer (RVTD), other laser devices, ultrasonic devices, other contact measurement device, any similar device, and combinations thereof, all of which are known to be capable of determining rotational speed and position, can be used to determine the rotational speed and position at the parent roll core plug.

As will be appreciated, the method can also utilize any conventional logic device, e.g., a programmable logic control system, for the purpose of receiving and processing data, populating the table, and using the table to determine the total correction factor for each of the sectors. Further, the programmable logic control system can then use the total correction factor for each sector to determine and implement the appropriate driving speed adjustment by undergoing a suitable initialization, data collection, data processing and control signal output routine.

In addition to the foregoing, the various measurements and calculations can be determined from a single set of data, or from multiple sets of data that have been averaged, or from multiple sets of data that have been averaged after discarding any anomalous measurements and calculations. For example, the web takeoff point radius, $R_{tp}(\mathbf{1}, \mathbf{2}, \ldots n)$, for each of the data collection sectors, 1, 2, . . . n, can be measured a plurality of times and averaged to determine an average takeoff point radius, $R_{tpAverage}(\mathbf{1}, \mathbf{2}, \ldots n)$, for each of the data collection sectors, 1, 2, . . . n, to be used in calculating the web takeoff point correction factors. Further, the plurality of measurements for each of the data collection sectors, 1, 2, . . . n, of the web takeoff point radius, $R_{tp}(\mathbf{1}, \mathbf{2}, \ldots n)$ can be analyzed relative to the average takeoff point radius, $R_{tpAverage}(\mathbf{1}, \mathbf{2}, \ldots n)$ for the corresponding one of the data collection sectors, 1, 2, . . . n, and anomalous values deviating more than a preselected amount above or below the average takeoff point radius, $R_{tpAverage}(\mathbf{1}, \mathbf{2}, \ldots n)$, for the corresponding one of the data collection sectors, 1, 2, . . . n, can be discarded and the remaining measurements for the corresponding one of the data collection sectors, 1, 2, . . . n, can be re-averaged. Similarly, the drive point radius, $R_{dp}(\mathbf{1}, \mathbf{2}, \ldots n)$, for each of the data collection sectors, 1, 2, . . . n, can be calculated a plurality of times and averaged to determine an average drive point radius, $R_{dpAverage}(\mathbf{1}, \mathbf{2}, \ldots n)$, for each of the data collection sectors, 1, 2, . . . n, to be used in calculating the drive point correction factors. Further, the plurality of calculations for each of the data collection sectors, 1, 2, . . . n, of the drive point radius, $R_{dp}(\mathbf{1}, \mathbf{2}, \ldots n)$, can be analyzed relative to the average drive point radius, $R_{dpAverage}(\mathbf{1}, \mathbf{2}, \ldots n)$, for the corresponding one of the data collection sectors, 1, 2, . . . n, and anomalous values deviating more than a preselected amount above or below the average drive point radius, $R_{dpAverage}(\mathbf{1}, \mathbf{2}, \ldots n)$, for the corresponding one of the data collection sectors, 1, 2, . . . n, can be discarded and the remaining measurements for the corresponding one of the data collection sectors, 1, 2, . . . n, can be re-averaged. In addition, the total correction factor $C_t(\mathbf{1}, \mathbf{2}, \ldots n)$, can be determined a preselected time before each of the data collection sectors, 1, 2, . . . n, reaches the drive point to provide time for adjusting the driving speed of the motor-driven belt by the time each of the data collection sectors, 1, 2, . . . n, reaches the drive point. It should be noted that it may be desirable to utilize either ASIC (Application Specific Integrated Circuit), FPGA (Field Programmable Gate Array) or a similar device in conjunction with the logic device which is preferably programmable for the functions listed above, such as the taking of multiple laser distance readings, averaging these readings, discarding data outside a set range, and recalculating the acceptable readings to prevent the logic device from being burdened with these tasks.

As will be appreciated from the foregoing, the terms ideal speed reference signal, $SRS_i$, and corrected speed reference signal, $SRS_{iCorrected}$, as used herein may comprise: i) signals indicative of the ideal driving speed and the corrected driving speed, respectively, to at least approximate the web feed rate of an ideal parent roll, or ii) the actual values for the ideal driving speed and the corrected driving speed, respectively and, therefore, these terms are used interchangeably herein and should be understood in a non-limiting manner to cover both possibilities.

In the several figures and the description herein, the out-of-round parent roll has been considered to be generally elliptical in shape and it has been contrasted with a perfectly round parent roll. These observations, descriptions, illustrations and calculations are merely illustrative in nature and are to be considered non-limiting because parent rolls that are out-of round can take virtually any shape depending upon a wide variety of factors. However, the method disclosed and claimed herein is fully capable of reducing feed rate variations in a web material as it is being unwound from a parent roll regardless of the actual cross-sectional shape of the circumference of the parent roll about the longitudinal axis.

While the invention has been described in connection with web substrates such as paper, it will be understood and appreciated that it is highly beneficial for use with any web material or any convolutely wound material to be unwound from a roll since the problem of reducing feed rate variations in a web material induced by geometry variations in a parent roll are not limited to paper. In every instance, it would be highly desirable to be able to fine tune the driving speed on a sector-by-sector basis as the parent roll is rotating in order to be able to maintain a constant or nearly constant feed rate of a web coming off of a rotating parent roll to avoid web tensions spikes or slackening.

In implementing the invention, it may be desirable to provide a phase correction factor to present the total correction factor to the drive train ahead of when it is needed in order to properly address system response time. To provide a phase correction factor, it may be desirable to utilize ASIC (Application Specific Integrated Circuit), FPGA (Field Programmable Gate Array) or a similar device in conjunction with a PLC (Programmable Logic Controller) or other logic device to assist with the high speed processing of data. For example, the creation of virtual sectors or the execution of the smoothing algorithm (both of which are be discussed below) could be done via one of these technologies to prevent the logic device from being burdened with these tasks. However, it should be noted that the use of ASICs or FPGAs would be a general data collection and processing strategy that would not be limited to implementation of the phase correction factor.

In addition, it is possible that the differences in the total correction factor from sector to sector are greater than what can practically be presented to the control system as an instantaneous change. Therefore, it can be advantageous to process the data to "smooth" out the transitions prior to presenting final correction factors to be implemented by the control system. Also, due to system response time, it may be desirable to present the final correction factors several degrees ahead of when they are required so the control system can respond in a timely manner.

In order to facilitate the implementation of these features, it is useful to further divide the parent roll into a plurality of virtual sectors that are smaller than the actual angular sectors which are used for measuring and calculating the correction factors. The number of virtual sectors will be an integer multiple of the number of actual angular sectors, will each be directly correlated to an actual angular sector, and will initially take on the same value as the total correction factor for the actual angular sector to which they are correlated. For example, if the parent roll is divided into a total of 20 actual angular sectors, each actual angular sector comprises 18° of the parent roll so if 360 virtual sectors are created, each of the actual angular sectors can contain 18 virtual sectors. The 18 virtual sectors contained within each of the actual angular sectors can each initially be assigned the exact same total correction factor value, $C_t$, as that which has been determined as described in detail above for the actual angular sector in which they are contained. Next, a new data table can be created with 360 elements, one for each virtual sector, and it can be populated with the information for virtual sectors so a smoothing algorithm can be applied to eliminate significant step changes in the actual angular sectors.

Figure 11:
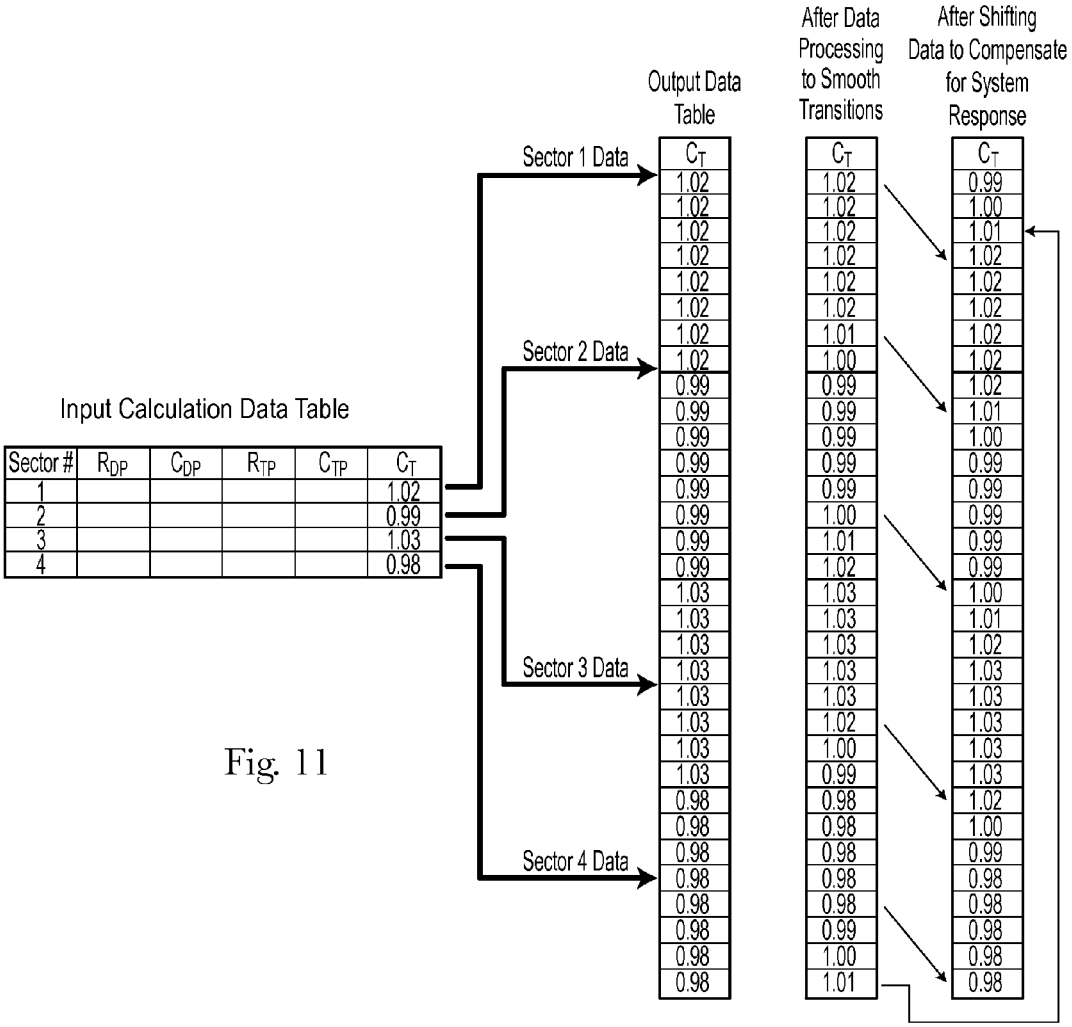
FIG. 11 is an example of a data table illustrating four actual angular sectors each divided into eight virtual sectors for smoothing transitions.

This new table with 360 elements, one per degree of parent roll circumference, can permit phasing of data to the control system in one degree increments based upon the combined response time of the control system and the drive system. In order to illustrate the concept, FIG. 11 shows an arrangement in which each of four actual angular sectors has been divided into eight virtual sectors. The first, or "Output Data Table", column shows the total correction factor, $C_t$, value for each of actual angular sectors 1-4 initially being assigned to all of the eight virtual sectors into which the actual angular sector has been divided, e.g., the eight virtual sectors for actual angular sector 1 all have a value for the total correction factor, $C_t$, of 1.02. As shown, the total correction factor assigned to all eight virtual sectors for actual angular sector 2 is 0.99, for actual angular sector 3 is 1.03, and for actual angular sector 4 is 0.98. Next, the second, or "After-Data processing to Smooth Transitions," column is completed to smooth the transitions between the virtual sectors after the initial data processing has been completed. In particular, the step in the total correction factor, C, between actual angular sector 1 and actual angular sector 2 is 0.03 so the last two virtual sectors for actual angular sector 1 are each reduced by 0.01, i.e., the second to last virtual sector is reduced to 1.01 and the last virtual sector is reduced to 1.00 to modulate the step and create a smooth transition between actual angular sector 1 and actual angular sector 2. Accordingly, the step from the last virtual sector for actual angular sector 1 to the first virtual sector for actual angular sector 2 is also 0.01 creating a smooth transition comprised of equal steps of 0.01.

Similarly, the step in the total correction factor, C, between actual angular sector 2 and actual angular sector 3 is 0.04 so the last three virtual sectors for actual angular sector 2 are each increased by 0.01, i.e., the third to last virtual sector is increased to 1.00, the second to last virtual sector is increased to 1.01 and the last virtual sector is increased to 1.02 to modulate the step and create a smooth transition between actual angular sector 2 and actual angular sector 3 rather than a single, large step of 0.04. Accordingly, the step from the last virtual sector for actual angular sector 2 to the first virtual sector for actual angular sector 3 is also 0.01 again creating a smooth transition comprised of equal steps of 0.01.

As will be seen from FIG. 11, the same logic is applied for forming the smooth transitions from actual angular sector 3 to actual angular sector 4, although it will be appreciated that the number of actual angular sectors, number of virtual sectors, number of steps, and value for each step are merely illustrative, non-limiting examples to demonstrate the process for smoothing transitions between actual angular, or data collection, sectors.

After smoothing transitions between the actual angular sectors in the manner described, the virtual sectors are each moved ahead by three sectors. In other words, the first virtual sector for actual angular sector 1 in column 2 is shifted down three places to the position for the fourth virtual sector for actual angular sector 1, the last virtual sector for actual angular sector 4 is shifted up three places to the position for the third virtual sector for actual angular sector 1, the second to the last virtual sector is shifted up three places to the position for the second virtual sector for actual angular sector 1, etc. FIG. 11 illustrates the data for every one of the virtual sectors obtained as described above being shifted by three places to a new virtual sector position in order to compensate for system response time.

The third column represents a continuous data loop of total correction factors for all of the virtual sectors where, in FIG. 11, there are a total of 32 virtual sectors. While this illustration is presented to understand the concept, in practice the total number of virtual sectors comprises x times n where n is the number of actual angular, or data collection, sectors and x is the number of virtual sectors per actual angular sector. The total correction factors for each of the virtual sectors in the continuous data loop can be shifted forward or rearward by a selected number of virtual sectors.

FIG. 11 illustrates shifting data by three places forward as a non-limiting example, but it will be understood that the data can be shifted forward or rearward in the manner described herein by more or less places depending upon system and operational requirements.

The dimensions and values disclosed herein are not to be understood as being strictly limited to the exact dimensions and numerical values recited. Instead, unless otherwise specified, each such dimension and values is intended to mean both the recited dimension or value and a functionally equivalent range surrounding that dimension or value. For example, a dimension is disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for reducing feed rate variations in a web material when unwinding a parent roll about a longitudinal axis to transport the web material away from the parent roll at a web takeoff point, the method comprising the steps of:

dividing the parent roll into a plurality of angular sectors disposed about the longitudinal axis;

using an ideal speed reference signal to drive the parent roll at a driving speed corresponding to a web feed rate of a round parent roll and at a drive point being disposed on the outer surface either coincident with or spaced from the web takeoff point;

correlating each of the sectors at the web takeoff point with a corresponding one of the sectors at the drive point;

determining a rotational speed for each of the sectors, while at the drive point, as the parent roll is being driven;

calculating a drive point radius of each of the sectors by calculating the radius at the drive point of the parent roll for each of the sectors as a function of the driving speed and the rotational speed;

calculating an ideal drive point radius by determining an average for the drive point radii for all of the sectors;

calculating a drive point correction factor for each of the sectors as a function of the drive point radius and the ideal drive point radius;

measuring a web takeoff point radius for each of the sectors by measuring the radius at or near the web takeoff point of the parent roll for each of the sectors as the parent roll is being driven at the drive point;

calculating an ideal web takeoff point radius by determining an average for the web takeoff point radii for all of the sectors;

calculating a web takeoff point correction factor for each of the sectors as a function of the ideal web takeoff point radius and the web takeoff point radius;

calculating a total correction factor for each of the sectors as a function of the drive point correction factor and the web takeoff point correction factor;

multiplying the total correction factor for each of the sectors by the ideal speed reference signal to establish a corrected speed reference signal for each of the sectors; and, adjusting the driving speed of the parent roll for each of the sectors to a corrected driving speed as each of the sectors approaches or is at the drive point using the corrected speed reference signal to at least approximate the web feed rate of the round parent roll to reduce feed rate variations in the web material at the web takeoff point.

2. The method of claim 1 further comprising the step of dividing the parent roll into 1, 2, . . . n equal angular sectors about the longitudinal axis.

3. The method of claim 2 further comprising the step of calculating the ideal drive point radius by adding the drive point radii for all of the sectors 1, 2, . . . n to determine a sum and dividing the sum by the total number of sectors, n.

4. The method of claim 2 further comprising the step of calculating the drive point correction factor for each of the sectors 1, 2, . . . n by using the formula:

$$C_{dp}(1, 2, \ldots n)=R_{dp}(1, 2, \ldots n)/R_{dpi}$$

where:

$R_{dp}$(1, 2 , . . . n) is the drive point radius for each of the sectors 1, 2 , . . . n ; and, $R_{dpi}$ is the ideal drive point radius.

5. The method of claim 2 further comprising the step of calculating the ideal web takeoff point radius by adding the web takeoff point radii for all of the sectors 1, 2, . . . n to determine a sum and dividing the sum by the total number of sectors n.

6. The method of claim 2 further comprising the step of calculating the web takeoff point correction factor for each of the sectors 1, 2, . . . n by using the formula:

$$C_{tp}(1, 2, \ldots n)=R_{tpi}/R_{tp}(1, 2, \ldots n)$$

where;

$R_{tp}$(1, 2, . . . n) is the web takeoff point radius for each of the sectors 1, 2, . . . n; and, $R_{tpi}$ is the ideal web takeoff point radius.

7. The method of claim 2 further comprising the step of calculating the total correction factor for each of the sectors 1, 2, . . .n by using the formula:

$$C_t(1, 2, \ldots n)=C_{dp}(1, 2, \ldots n)\times C_{tp}(1, 2, \ldots n)$$

where:

$C_{dp}$(1, 2, . . . n) is the drive point correction factor for each of the sectors 1, 2, . . . n; and, $C_{tp}$(1, 2, . . . n) is the web takeoff point correction factor for each of the sectors 1, 2, . . . n.

8. The method of claim 2 further comprising the step of dividing each of the angular sectors, 1, 2, . . . n, into a plurality of equal virtual sectors, 1, 2, . . . x and a data table is created having a first column for total correction factor output data to be entered, the total correction factor calculated for each of the angular sectors, 1, 2, . . . n, being entered into the data table for all of the virtual sectors, 1, 2, . . . x, in the data table corresponding to each of the angular sectors 1, 2, . . . n.

9. The method of claim 8 wherein the data table includes a second column for adjusting the total correction factor in one or more of the virtual sectors, 1, 2, . . . x, corresponding to one of the angular sectors, 1, 2, . . . n, in order to modulate any step between, and thereby smooth the transition from, the total correction factor for one of the angular sectors, 1, 2, . . . n, and the total correction factor for the next adjacent one of the angular sectors, 1, 2, . . . n.

10. The method of claim 9 wherein the data table includes a third column for shifting the total correction factors in the second column for the virtual sectors, 1, 2, . . . x, corresponding to all of the angular sectors, 1, 2, . . . n and comprising a continuous data loop comprised of a total of x times n virtual sectors wherein the total correction factors for each of the virtual sectors is shifted forward or rearward by a selected number of the virtual sectors.

11. The method of claim 1 further comprising the step of driving the parent roll by a motor-driven belt in contact with the outer surface thereof.

12. The method of claim 1 further comprising the step of determining the rotational speed by measurement at or near the longitudinal axis.

13. The method of claim 1 further comprising the step of calculating the drive point radius for each of the sectors using the formula:

$$R_{dp}=M_i/2\pi\Omega_i$$

where:

$M_i$, is the driving speed for the parent roll; and, $\Omega_i$, is the rotational speed when each of the sectors is at the drive point.

14. The method of claim 1 further comprising the step of measuring the web takeoff point radius for each of the sectors using a distance measurement device at or near the web takeoff point.

15. The method of claim 14 further comprising the step of measuring the web takeoff point radius for each of the sectors using a distance measurement selected from the group consisting of lasers, ultrasonic devices, and combinations thereof.

* * * * *